United States Patent [19]

Khoury

[11] 3,951,299

[45] Apr. 20, 1976

[54] HORSE-SHOE SHAPED VENT SCORE

[75] Inventor: Nick S. Khoury, Worth, Ill.

[73] Assignee: Continental Can Company, Inc., New York, N.Y.

[22] Filed: May 27, 1975

[21] Appl. No.: 581,383

[52] U.S. Cl. ..... 220/273; 220/271
[51] Int. Cl.[2] ..... B65D 41/32
[58] Field of Search ..... 220/270, 271, 272, 273

[56] References Cited

UNITED STATES PATENTS

| | | | |
|---|---|---|---|
| 3,527,378 | 9/1970 | Scharf et al. | 220/273 |
| 3,724,709 | 4/1973 | Westphal | 220/273 |

*Primary Examiner*—George T. Hall
*Attorney, Agent, or Firm*—John J. Kowalik; Joseph E. Kerwin; William A. Dittmann

[57] ABSTRACT

An improved easy-open end closure has a generally C-shaped ancillary scoreline in the end panel closely adjacent a rivet which is positioned between a piercing portion of a tab to which it is attached and at least a portion of the rupturable ancillary scoreline. The peculiar shape of the scoreline, with its inwardly looped ends, facilitates movement of the handle portion of the tab away from the end panel by rendering the adjacent portion of the end panel more flexible and minimizes tear out of the flexing portion of the panel by substantially eliminating areas of stress concentration.

11 Claims, 3 Drawing Figures

HORSE-SHOE SHAPED VENT SCORE

BACKGROUND OF THE INVENTION

An easy-opening container closure of the full panel pull-out type has a panel removable from the container wall and a tab secured to the panel to effect the removal thereof. This type of easy-opening container usually has a front opening tab, i.e., a tab of the type in which the forward end or nose engages the container wall adjacent an edge of the removal panel to initiate severance of the panel from the container.

More particularly, easy-opening closures of this type typically include a rupturable scoreline in the container end panel defining the removable panel, a tab having a handle portion and a piercing portion, and a rivet integral with the panel for securing the tab to the removable panel. The piercing portion of the tab is at the forward or nose end of the tab and lies closely adjacent the rupturable scoreline.

In operation of this closure, the handle portion of the tab is moved away from the removable panel to force the piercing portion of the tab against the rupturable scoreline or against the removable panel closely adjacent the scoreline. As the tab is secured to the removable panel by the rivet, such upward movement of the handle portion thereof tends to flex the removable panel adjacent the rivet. As the upward movement of the handle portion continues, it eventually becomes necessary for a section of the panel to bend about a bend line to allow for full upward movement of the handle portion of the tab. With a longitudinally rigid tab the bend line forms intermediate the rivet and the center of the end panel. A problem arises in this connection in that it is relatively hard to bend such a large section of the panel about the bend line. Furthermore, large bend sections are generally undesirable in that they disturb the product within the container.

In an attempt to make easy-opening closures of this type more easily opened, it has been suggested to form a lance in the tab. The tab is then riveted to the container end panel through the lanced portion thereof. This lancing of the tab provides the tab with an integral bend line and reduces the bend section size; however, it does not obviate the need for forming a bend line fully across the section of the removable panel during panel removal. Furthermore, the lancing of the tab further complicates the tab construction and makes the tab subject to failure by tearing and otherwise.

It is often necessary or desirable to form a vent opening in an easy-opening closure before the initial severance of the removable panel from the end panel. Such vents may be desirable where the product within the container is under pressure or vacuum and it is wished to release or admit pressure prior to beginning removal of the panel.

Heretofore, such vent openings have been formed only with rear opening tabs, i.e., those tabs that are secured to a tear strip intermediate the ends of the tab and such intermediate portion of the tab lifts the leading edge of the tear strip to initiate severance thereof. One such device includes a complicated hinged tab arrangement secured to a tear strip in an end panel by a first rivet. The tab is further secured to the end panel by a vent rivet which is spaced from the first rivet and lies outside of the tear strip. When the tab is manipulated to open the container, the vent rivet is removed by a shearing action before the tab is operative to remove the tear strip from the end panel. This arrangement is fraught with disadvantages, among which are the complexity of the tab, the need for a second rivet, and the additional force required to remove the vent rivet by a shearing action. Furthermore, this prior art device would not be suited for use with a front opening tab.

SUMMARY OF THE INVENTION

The present invention provides an easy-opening container end closure which is particularly suited for use on full panel pull-outs and may also be used with a front opening tab. Furthermore, the present invention facilitates initial severance of the removable panel from the end panel. The invention eliminates the need for lancing of the tab and, therefore, simplifies tab construction and eliminates the danger of tab or end panel failure that may otherwise be present.

The concepts of the present invention are particularly applicable to an easy-opening end closure of the type having a scoreline defining a flap or panel in the end panel at least partially removable therefrom and a tab having a handle portion and a piercing portion. The tab is secured to the end panel intermediate the handle portion and piercing portion by a rivet or other suitable interconnecting means.

With an easy-opening end closure of the type described above, the present invention teaches providing a generally U-shaped ancillary scoreline in the end panel closely adjacent the rivet, with the rivet lying between the piercing portion of the tab and at least a portion of the rupturable ancillary scoreline. This scoreline accomplishes two very important functions. The first function is to facilitate movement of the handle portion of the tab away from the end panel to initiate severance of the flap. Rupturing of the ancillary scoreline renders the adjacent portion of the end panel more flexible so that the panel offers considerably less resistance to the upward movement of the tab.

As the handle portion of the tab is raised further, a bend line forms in the end panel. Heretofore, ancillary scorelines have been formed with outwardly turned end configurations. In such cases, the bend line takes the form of two bend line segments extending generally laterally from the ends of the ancillary scoreline, respectively, toward the opening scoreline. These bend line segments of the end panel along the two line segments require a difficult twisting of the end panel and often result in an eccentric movement of the pivotable portion of the end panel and misalignment of the piercing portion of the tab relative to the opening scoreline, as well as tearing of the end panel along one of the bend lines. In the improved scoreline of the present, the bend line comprises a single straight line segment joining the two inwardly curled scoreline end configurations. Thus, the present invention effectively shortens the length of the bend line that must be formed in the end panel while insuring proper movement of the pivotable segment of the end panel to bring the piercing portion of the tab into contact with the opening scoreline. Finally, as the pivotable segment is rotated about the bend line, the location of the fulcrum about which the tab pivots is moved closer to the opening scoreline, thereby increasing the mechanical advantage and further facilitating opening.

A second important function of the ancillary scoreline is to provide a relatively small vent opening in the end panel through which gases within the container may escape. The vent opening is formed prior to the time that the piercing portion of the tab ruptures the opening scoreline to initiate severance of the flap from the end panel.

An important feature of the present invention is that the tab can be entirely longitudinally rigid and there is no need for lancing of the tab. With the present invention, the longitudinally rigid tab acts first as a rear opening tab to rupture the ancillary scoreline and secondly as a front opening tab to initiate severance of the flap from the end panel. During the second phase of tab movement, the ancillary scoreline is operative to cause the bend line segments in the end panel to function as an easily operable hinge to facilitate continued swinging action of the tab.

Use of the rupturable ancillary scoreline introduces the possibility that once the metal of the end panel begins tearing along the ancillary scoreline, it will continue tearing beyond the ends of the scoreline. To obviate this potential problem, the end configurations of the scoreline are curled away from the piercing portion of the tab and toward each other, as well as toward the rivet, forming tear stops at the scoreline ends.

Experimentation has indicated that the particular ancillary scoreline configuration of the present invention is applicable to a wide variety of sizes and types of containers with the "scale" or size of the scoreline determined by the size of the rivet. This allows standardization of design and facilitates production of a diversified product line.

Further, use of the ancillary scoreline permits mounting of the tab such that, prior to opening, the piercing member is not immediately adjacent the opening scoreline. This prevents unintentional rupture of the opening scoreline due to accidental impact on the tab, as may occur during handling of the container.

BRIEF DESCRIPTION OF THE DRAWINGS

The various features and advantages of the ancillary scoreline of this invention will be more apparent from the following detailed description when considered in connection with the accompanying drawing wherein.

DESCRIPTION OF THE PREFERRED EMBODIMENT

Figure 1:
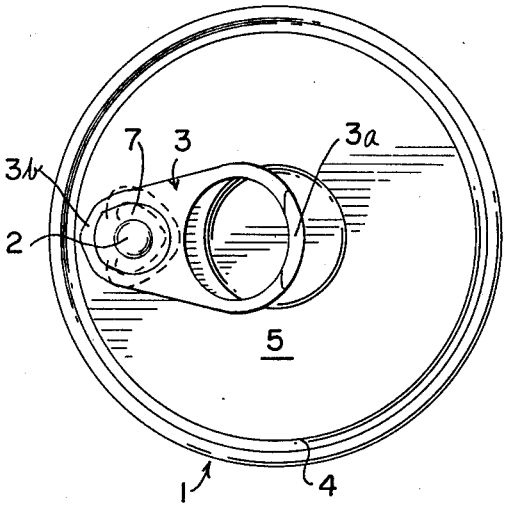
FIG. 1 is a top plan view of an easy-open end closure constructed in accordance with the teachings of the present invention.
Figure 2:
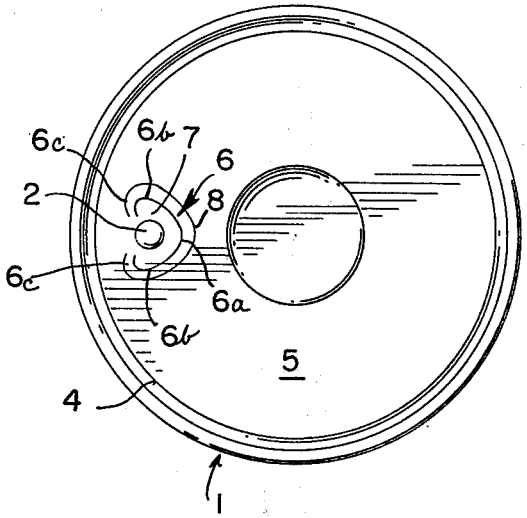
FIG. 2 is a top plan view similar to FIG. 1, wherein the tab has been removed to illustrate the location and orientation of the ancillary scoreline.
Figure 3:
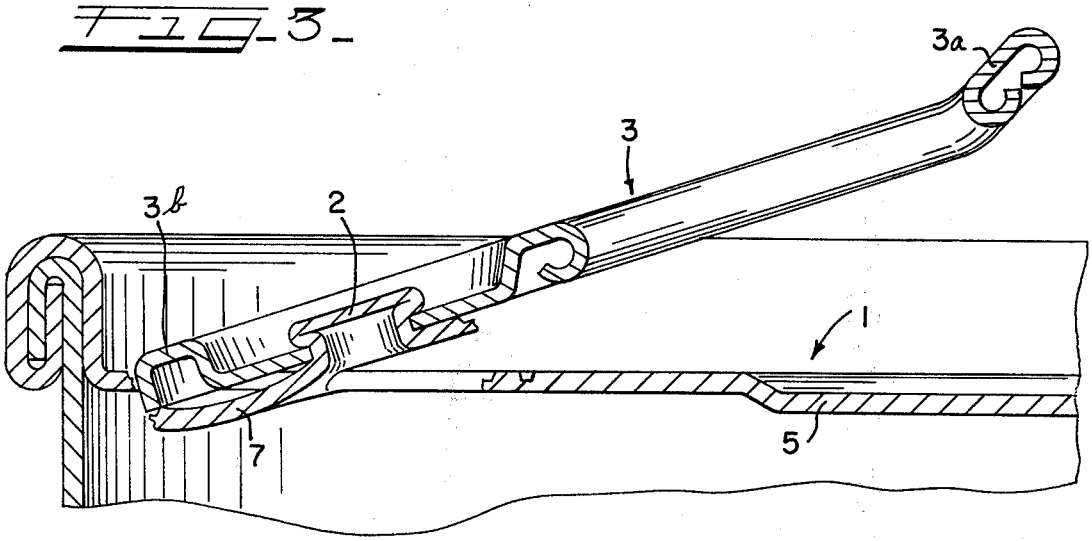
FIG. 3 is a fragmentary side view of the end closure of FIG. 1 in a partially opened condition.

FIGS. 1 and 3 illustrate a self-opening end closure comprising a metal end panel 1, a rivet 2 integrally formed in said end panel 1 and a rigid metal pull tab 3 fixedly attached to said panel 1 by said rivet 2. A scoreline 4 is formed in the end panel 1 and defines an opening flap 5 therein.

The tab 3 comprises a handle portion 3*a* and a piercing or score rupturing portion 3*b*. With the end closure in the unopened condition (FIG. 1) the piercing portions 3*b* of the tab 3 lies against the end panel 1 radially inward of the flap-defining scoreline 4.

A C-shaped ancillary scoreline 6 is formed in the end panel 1 and sets off a pivotable segment 7 therein. The scoreline 6 is adjacent the rivet 2 and comprises a bight portion 6*a* and end portions 6*b* terminating is distal end configurations 6*c*. The bight portion 6*a* partially embraces the rivet 2 on the side thereof remote from the flap-defining scoreline 4. The end configurations 6*c* curl away from the flap-defining scoreline 4 and toward each other as well as toward the rivet 2. The final turn toward the rivet 2 serves a tear-stop to prevent undesired tearing of the end panel 1. An anti-fracture scoreline 8 is formed in the end panel 1, parallel to the ancillary scoreline 6, on the side thereof nearer the end panel center.

The ancillary scoreline 6 is scored to a depth such that relative strength of the end panel 1 therealong, in comparison to the stress applied thereto consequent to opening the end closure, is less than the strength of the end panel 1 along the flap-defining scoreline 4, in comparison to the stress applied thereto consequent to opening. As a result of this strength relationship, movement of the handle portion 3*a* of the tab 3 away from the end panel 1 results in rupture of the ancillary scoreline 6 prior to the rupture of the flap-defining scoreline 4.

In operation of this closure, the handle portion 3*a* of the tab 3 is moved away from the end panel 1. As the tab 3 is secured to the pivotable segment 7 of the end panel 1, such upward movement of the tab 3 imparts an upward force on the pivotable segment 7 which results in rupture of the ancillary scoreline 6. At this point, the rupture scoreline 6 acts as a vent opening through which gases may enter or escape the container. The vent is shielded by the tab 3 which overlies the ruptured area. Continued upward movement of the tab 3 causes controlled tearing of the end panel 1 along the scoreline 6. As the upward movement of the tab 3 continues, the pivotable segment 7 of the end panel 1 bends upwardly about a bend line joining the two end configurations 6*c* of the scoreline 6. During this movement of the pivotable segment, the tab 3 is displaced radially outwardly, such that the piercing portion 3*b* is brought to a position overlying the flap-defining scoreline 6. Opening of the container is now completed in the conventional manner.

It is to be noted that the piercing portion 3*b* of the tab 3 overlies the flap-defining scoreline 4 only after intentional opening of the container has been initiated. Thus, accidental impacts on the piercing portion 3*b*, as may result from improper handling of the container, merely force the portion 3*b* against the end panel 1 radially inwardly of the scoreline 4 and do not cause an unintentional rupture of scoreline 4.

Further, the tab 3 is displaced, the location of the fulcrum about which the tab 3 pivots is moved closer to the flap-defining scoreline 4, thereby increasing the mechanical advantage of the tab 3 and reducing the effort required to open the container.

What is claimed is:

1. In an easy-opening end closure, the combination of:

a scoreline formed in the end panel and defining an opening flap therein;

a tab for initiating rupture of said scoreline, said tab comprising a handle portion and a score-rupturing portion;

interconnecting means for attaching said tab intermediate said portions thereof to said end panel whereby movement of said handle portion of said tab away from said end panel forces said score-rupturing portion toward said end panel; and ancillary scoreline means formed in the end panel adjacent said interconnecting means rupturable in response to movement of said handle portion of said tab away from said end panel to form a pivotable segment in said end panel, said ancillary scoreline being generally horseshoe-shaped and having a bight portion and end portions terminating in distal end configurations, said ancillary score partially embracing said interconnecting means with said bight portion remote from said flap-defining scoreline and said end configurations curled away from said flap-defining score-line and toward each other as well as toward said interconnecting means.

2. In an easy-open end closure, the combination of:

a scoreline formed in the end panel and defining an opening flap therein, said flap being at least partially removable from said end panel;

a longitudinally rigid tab for removing said flap from said end panel, said tab comprising a handle portion and a piercing portion;

interconnecting means for attaching said tab to said end panel whereby movement of said handle portion of said tab away from said end panel forces said piercing portion toward said end panel; and a line of weakness in said end panel, said line of weakness having end portions spaced from said flap-defining scoreline, said interconnecting means lying between a portion of said line of weakness and said scoreline whereby movement of said handle portion of said tab away from said end panel stresses and ruptures said end panel along said line of weakness to provide a pivotable segment in said end panel, said line of weakness being generally C-shaped and having a bight portion and end portions terminating in distal end configurations, said bight portion partially embracing said interconnecting means with said bight portion remote from said flap-defining scoreline and said end configurations being looped inwardly away from said flap-defining scoreline.

3. A combination as defined in claim 1, wherein said interconnecting means comprises a rivet integrally formed in said end panel.

4. A combination as defined in claim 2, wherein said interconnecting means comprises a rivet integrally formed in said end panel.

5. An improved easy-open end closure of the type having a removable flap defined in an end panel by a scoreline, a longitudinally rigid pull tab overlying said removable flap, means permanently securing said pull tab to said removable flap, said end panel having an area thereof which is stressed during the initial movement of said pull tab while applying a force to said end panel along said scoreline, and a second scoreline disposed in said stressed area, said second scoreline being generally U-shaped and having a bight portion and end portions terminating in distal end configurations, the bight portion partially embracing said securing means with said bight portion remote from said flap-defining scoreline and said end configurations curled away from said flap-defining scoreline and toward each other as well as toward each other as well as toward said securing means, the relative strength of said end panel along said second scoreline in comparison to the stress applied thereto being less than the strength of said end panel along said first scoreline in comparison to the stress applied thereto whereby said end panel will first rupture along said second scoreline.

6. The improved end closure as described in claim 1, wherein said score rupturing portion of said tab is radially inward of said opening scoreline when said end closure is in the unopened condition.

7. The improved end closure as described in claim 2, wherein said score rupturing portion of said tab is radially inward of said opening scoreline when said end closure is in the unopened condition.

8. The improved end closure as described in claim 1, wherein said pivotable segment pivots about a bend line, formed in said end panel, connecting said end configurations of said ancillary scoreline.

9. The improved end closure as described in claim 2, wherein said pivotable segment pivots about a bend line, formed in said end panel, connecting said end configurations of said ancillary scoreline.

10. The improved end closure as described in claim 8, wherein said tab is displaced radially outwardly consequent to rupture of said ancillary scoreline.

11. The improved end closure as described in claim 9, wherein said tab is displaced radially outwardly consequent to rupture of said ancillary scoreline.

* * * * *